United States Patent [19]

Petrin

[11] 4,295,677

[45] Oct. 20, 1981

[54] SELF-DUMPING HOISTING BUCKET ASSEMBLY

[76] Inventor: Jerome A. Petrin, 9105 SW. Mt. View La., Tigard, Oreg. 97223

[21] Appl. No.: 94,046

[22] Filed: Nov. 14, 1979

[51] Int. Cl.[3] ..... E04G 21/02

[52] U.S. Cl. ..... 294/73

[58] Field of Search ..... 294/73, 67 DC, 67 AA, 294/67 E; 414/592, 425; 212/79, 136, 137

[56] References Cited

U.S. PATENT DOCUMENTS

| | | | |
|---|---|---|---|
| 540,116 | 5/1895 | Smith | 294/73 |
| 870,409 | 11/1907 | Baus | 294/73 |
| 916,331 | 3/1909 | Lance | 294/73 |
| 1,568,488 | 1/1926 | Weeks | 294/73 |
| 2,159,065 | 5/1935 | Weeks et al. | 294/73 |
| 2,798,758 | 7/1957 | Yakopec | 294/73 |
| 3,314,710 | 4/1967 | Edeburn | 294/73 |

FOREIGN PATENT DOCUMENTS

| | | | |
|---|---|---|---|
| 254206 | 7/1926 | United Kingdom | 294/73 |
| 334604 | 9/1930 | United Kingdom | 294/73 |
| 547746 | 9/1942 | United Kingdom | 294/73 |

*Primary Examiner*—James B. Marbert

*Attorney, Agent, or Firm*—Eugene D. Farley

[57] ABSTRACT

A self-dumping hoisting bucket assembly of the class tiltable for discharging its contents through a front discharge chute, the bucket being releasable for dumping upon slackening a flexible hoisting suspension by which it is supported. The forward corners of the bucket, near the discharge chute, are equipped with downward opening hooks. The hoisting suspension includes flexible forward support members which releasably engage the hooks, and flexible rearward support members which support the rear of the bucket. The forward support members are attached to a cross beam which is maintained in a horizontal position above the bucket in such a manner that the forward members lie substantially exterior of the space vertically above the bucket.

4 Claims, 6 Drawing Figures

SELF-DUMPING HOISTING BUCKET ASSEMBLY

BACKGROUND OF THE INVENTION

This invention relates to hoisting bucket assemblies. It more particularly pertains to a hoisting bucket assembly having a releasable bucket providing a tilting discharge.

Hoisting buckets of the general class of the present invention are well known in the art. Weeks, U.S. Pat. No. 2,159,065 discloses a scale box having a similar general function and operation. British Pat. Nos. 334,604 and 547,746 are also of interest.

While the inventions disclosed in the foregoing patents had past utility, the advent of modern large materials-moving machinery makes them of less practical importance. The loading of a hoisting bucket now involves backing a dump truck into the bucket, raising the bed of the truck and dumping its full load into the bucket. This operation, it can be seen, would be impossible with the bail of British Pat. No. 334,604 and inconvenient with the pyramid chain suspension arrangement of U.S. Pat. No. 2,159,065 and British Pat. No. 547,746.

A further area for improvement over the prior art involves the insertion of chains or hooks or the like into the bucket chamber, or the possibility that the chains or hooks will fall into the bucket upon their release. Both of these conditions may increase the undesirable possibility of relatching the hook apparatus after release, or may promote snagging the bucket contents, preventing its complete discharge.

Another condition found in the prior art which promotes the undesirable possibility of non-release is illustrated in British Pat. No. 334,604. It can be seen that under the right conditions the chain may fall back around the shank of the hook, rather than falling loose when the supporting lines are slackened. In that event the bucket would not dump when lifted.

Still another area for improvement over the prior art involves providing a safety factor in the event that the load is accidentally set down, or is accidentally impeded in its descent to a discharge station. With the short, open hooks which are disclosed in the prior art, inadvertent release of the latching mechanism can easily occur.

Accordingly, it is the general object of this invention to provide a self-dumping hoisting bucket assembly, particularly a cargo hoisting bucket assembly capable of transferring large amounts of material and which, when set down at its discharge station, automatically disengages part of its suspension system so that, upon re-lifting, the bucket tips and its contents are discharged.

It is another object of this invention to provide a bucket suspension system around which it is easy to maneuver large materials moving machinery.

It is yet another object of this invention to provide a releasable hooking arrangement which is not likely to interfere with the cargo.

It is a further object of this invention to provide a releaseable hooking arrangement which, when released, will not accidentally relatch.

It is a still further object of this invention to provide a bucket release mechanism which is not subject to accidental release.

GENERAL STATEMENT OF THE INVENTION

The present invention provides a self dumping hoisting bucket assembly having a tilting discharge, the bucket being suspended from a support by a flexible rearward suspensory means and a flexible forward suspensory means which is maintained substantially exterior of the space vertically above the bucket, the forward suspensory means having a coupler on the end thereof which releasably engages a hook, the hook having an elongated recess for receiving the coupler, and being attached to the bucket adjacent to the end through which the contents of the bucket are discharged.

DESCRIPTION OF THE PREFERRED EMBODIMENT

Figures 1, 2, 3, 4, 5, 6:
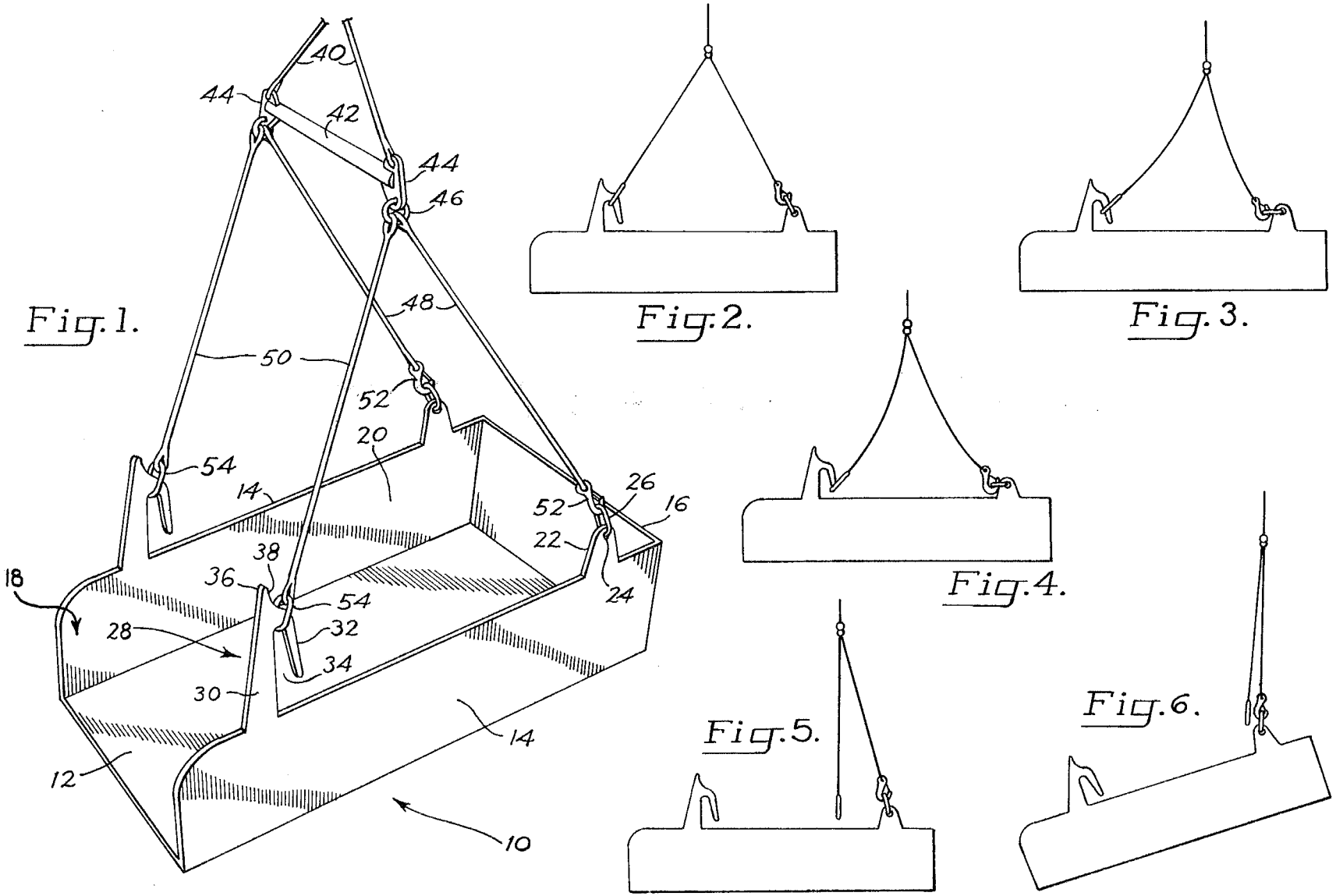
FIG. 1 is a top perspective view of the hoisting bucket assembly of my invention.
FIGS. 2–6 are schematic elevation views diagramming the sequential release of the hooking arrangement and the tilting discharge of the bucket.

As shown in FIG. 1, the self dumping hoisting bucket assembly of my invention comprises a generally rectangular bucket or box 10, including bottom 12, two upstanding side walls 14, an upstanding end wall 16 forming the rear of the box, and a discharge chute 18 opposite end wall 16 at the front of the box.

Discharge chute 18 preferably is completely open the width and depth of the front of box 10. However, it may if desired be partially closed, or have any suitable configuration, for instance that of a spout.

Top 20 of box 10 preferably is completely open.

Attached to each side wall 14 near the rear of box 10 is a tab 22 having hole 24 loosely mounting a rear ring 26.

Near the front of box 10 a hook indicated generally at 28 is attached to the top of each side wall 14. Hook 28 is comprised of a shank segment 30 attached at its base to the front portion of one of the side walls, reversely arranged retainer segment 32 attached to the top of the shank segment and extending partially back along the shank segment forming elongated recess 34, and coupler guard segment 36 which is attached to the top of the shank segment and is upstanding therefrom. The exterior edges of the coupler guard segment and the retainer segment form a smooth, downwardly sloping guiding surface 38.

It is preferable that shank segment 30 be rearwardly sloping from its point of attachment, and that retainer segment 32 be substantially vertical. While it is also preferable to have the shank segment attached to the top of side wall 14, it could be attached elsewhere, for instance on the exterior of the side wall. However, it is not desirable to mount the shank on the interior of box 10 or position the hook over the interior of the box where it might interfere with loading the bucket or engage and prevent complete discharge of the cargo.

It is also preferable to have coupler guard segment 36 upstanding from the top of the shank segment, but any outwardly projecting boss at this location serves the purpose of the coupler guard.

Now turning to the hoisting suspension system, in FIG. 1 the hoist is not shown, but could be a crane, derrick or the like. Depending from the hoist are sling members 40 suspending a support in the form of cross beam 42. Connectors 44 are mounted on and spaced apart by cross beam 42, and each mounts the lower end of one of the sling members 40 and a top ring 46.

Rearward suspensory members 48 and forward suspensory members 50 hingably depend from the top rings. The suspensory members are flexible and are preferably cables, but may be chains or ropes, or even inflexible rods provided with flexible links at their ends.

The lower ends of the rearward suspensory members 48 are attached to latched hooks 52 which are not automatically releasable, but are removably attached to rear rings 26. To the lower end of each of the forward suspensory members 50 is attached a coupler 54 which is configured and dimensioned for releasable engagement with hook 28.

While the above details the preferred embodiment of the suspensory means, it is noted that any means of hingably connecting the box 10 to the hoist in the proper spaced relation meets the requirements of the present invention.

OPERATION

The operational sequence of the present invention is shown diagrammatically in FIGS. 2-6.

The hoisting bucket is set down and loaded. This may be accomplished by backing a dump truck into box 10 and raising the bed of the truck to dump the cargo into the box. The preferred use of cross beam 42 makes this method of loading possible since forward suspensory members 50 lie substantially exterior of the space vertically above the box. After dumping, the truck is then driven out of the box. This procedure may be repeated several times until the bucket is loaded.

When the bucket is fully loaded, it is lifted by the hoist and assumes the attitude shown in FIG. 2. It is then lowered to its discharge station. Once set down, flexible suspensory members 48 and 50 become slack as shown in FIG. 3. Latched hooks 52 remain attached, but couplers 54 abut coupler guard segments 36 and are unable to slip over shanks 30. Consequently, they slide down guiding surfaces 38, clearing retainer segments 32, as shown in FIG. 4.

Forward suspensory members 50 then swing free of hooks 28 positively effecting release (FIG. 5). If, however, the bucket is accidentally set down, or otherwise impeded in its descent to its discharge station, the hoist operator has ample time to correct the error before couplers 54 are lowered the distance of elongated recess 34 and forward suspensory members 50 swing free.

In FIG. 6 the hoisting apparatus again pulls rearward suspensory members 48 taut, and tilts box 10 causing the materials to discharge through chute 18. Box 10 is then lifted to its loading station, set down and leveled, and couplers 54 are reengaged with hooks 28. The above sequence may then be repeated.

Having described my invention in its preferred embodiment, I claim:

1. A self dumping hoisting bucket assembly of the class releasable for dumping upon slackening a flexible hoisting suspension by which it is supported, the bucket assembly comprising:

(a) a box comprising a bottom, two upstanding side walls, an upstanding rear wall and a front end providing a discharge chute which is substantially open the width and depth of the front of the box and configured to receive a dump truck for loading the bucket;

(b) a pair of downwardly opening hooks adjacent the front of the box and substantially exterior of the space vertically above the interior of the box, one being attached to one side wall and the other being attached to the other side wall, each hook comprising an upright shank segment attached at its base to the front portion of one of the side walls, and a retainer segment attached to the top of the shank segment and arranged reversely to form a recess between the shank segment and the retainer segment; and (c) a hoisting suspension for the box comprising (1) a cross beam substantially as long as the box is wide and suspendable horizontally by a hoist above the box, (2) at least one flexible rearward suspensory member connecting the rear of the box to the cross beam, (3) a pair of flexible forward suspensory members connecting the front of the box to the cross beam, each including a coupler configured and dimensioned for releasable engagement with one of the hooks, and each being attached to the cross beam at a location such that it lies substantially exterior of the space vertically above the box, each hook having a coupler guard segment extending outwardly from the top of the shank and arranged upon slackening of the suspension to be engaged by the coupler to effect disengagement of the coupler from the hook.

2. The self dumping hoisting bucket of claim 1 wherein the coupler guard segment is upstanding from the top of the shank segment and the exterior edge surface of the coupler guard segment and the retainer segment forms a smooth, downwardly sloping guiding surface.

3. A self dumping hoisting bucket assembly of the class releasable for dumping upon slackening a flexible hoisting suspension by which it is supported, the bucket assembly comprising:

(a) a box comprising a bottom, two upstanding side walls, an upstanding rear wall and a front end providing a discharge chute, (b) a hoisting suspension for the box comprising (1) a support adapted for connection to a hoist, (2) at least one flexible rearward suspensory member connecting the rear of the box to the support, and (3) a pair of flexible forward suspensory members connecting the front of the box to the support, each including a coupler at its lower end; and (c) a pair of downwardly opening hooks, one being attached to one side wall and the other being attached to the other side wall, and each comprising (1) an upright shank segment attached at its base to the front portion of one of the side walls, (2) a retainer segment attached to the top of the shank segment and arranged reversely to form a recess between the shank segment and the retainer segment, and (3) a coupler guard segment extending outwardly from the top of the shank and arranged upon slackening of the suspension to be engaged by the coupler to effect disengagement of the coupler from the hook.

4. The self dumping hoisting bucket of claim 3 wherein the coupler guard segment is upstanding from the top of the shank segment and the exterior edge surface of the coupler guard segment and the retainer segment forms a smooth, downwardly sloping guiding surface.

* * * * *